United States Patent [19]

Colombo

[11] 4,188,753

[45] Feb. 19, 1980

[54] DOOR ARRANGEMENT, ESPECIALLY FOR A RESIDENTIAL STRUCTURE

[75] Inventor: Virginio Colombo, Bollate, Italy

[73] Assignee: Inventio AG, Hergiswil, Switzerland

[21] Appl. No.: 860,784

[22] Filed: Dec. 15, 1977

[30] Foreign Application Priority Data

Dec. 20, 1976 [CH] Switzerland ..... 15982/76

[51] Int. Cl.[2] ..... E05B 65/06

[52] U.S. Cl. ..... 49/394; 49/503; 292/5

[58] Field of Search ..... 49/394, 503; 292/5, 292/46, 47, 48, 49, 51, 52

[56] References Cited

U.S. PATENT DOCUMENTS

| | | | |
|---|---|---|---|
| 2,006,129 | 6/1935 | Craft | 49/394 X |
| 2,359,244 | 9/1944 | Polson | 49/394 X |
| 2,677,443 | 5/1954 | Kottick | 49/503 |
| 2,717,064 | 9/1955 | Hock | 49/394 |
| 3,969,845 | 7/1976 | Yulkowski | 49/394 |
| 3,988,859 | 11/1976 | Peterson | 49/394 |

FOREIGN PATENT DOCUMENTS

| | | | |
|---|---|---|---|
| 1956609 | 5/1971 | Fed. Rep. of Germany | 292/48 |
| 1398245 | 3/1965 | France | 49/394 |

*Primary Examiner*—Philip C. Kannan
*Attorney, Agent, or Firm*—Werner W. Kleeman

[57] ABSTRACT

A burglary proof door, especially for a residence, comprising a frame formed of metal hollow sections or profiles and a door faced with coverings and assembled together from metal hollow sections or profiles. In its closed position the door is guided both at its hinge side and lock side throughout its entire height in substantially U-shaped guides provided at the frame. The door part guided at the lock side in the frame comprises two rails movable transversely with respect to the direction of opening of the door and extending over the entire door height. The hinge side outer edge of the door is bevelled or tapered throughout its entire height and the substantially U-shaped guide provided at the hinge side-frame part is accommodated to such shape. The frame is constructed such that the edge of the door opening located in the wall of the structure is engaged in a substantially U-shaped manner, and the vertical edges of the door opening are constructed in a stepwise manner such that the inner horizontal width is greater than the outer horizontal width.

8 Claims, 5 Drawing Figures

DOOR ARRANGEMENT, ESPECIALLY FOR A RESIDENTIAL STRUCTURE

BACKGROUND OF THE INVENTION

The present invention relates to a new and improved construction of door arrangement, especially for a residential structure, particularly for closing the entrance of an apartment or home, comprising a door frame formed of metal hollow sections or profile members inserted into the door opening and a single-wing door faced or lined with coverings and composed of metal hollow sections or profile members, and further having internally situated hinges and a door lock having a locking bolt and catch.

With door arrangements conventionally employed for closing a residence, such as an apartment or a house, the door usually consists of wood or a material formed on the basis of wood, whereas the fixture of the door opening is formed of a frame of wood or metal. The door which usually opens towards the inside has a rectangular shoulder or projection at its edge which, when the door is closed, bears against the side of the frame confronting the interior of the apartment or house.

This prior art door arrangement is particularly associated with the drawback that when forced from the outside, for instance during a burglary or unauthorized entry, the applied forces must be taken up on the one hand by the locking bolt of the lock and on the other hand by the hinges of the door. The high specific pressures which occur either cause tearing away of the hinges at the door or at the frame, as the case may be, or tearing away of the counter-holder of the locking bolt at the frame or at the lock in the door, respectively. Also, it is possible that the frame, which as a general rule is not particularly anchored, can loosen from the edge of the door opening.

Certain improvements have been attained inasmuch as, on the one hand, the doors are partially fabricated from metal hollow sections faced or lined with coverings and, on the other hand, the frames likewise fabricated of metal hollow sections are anchored at the edge of the door opening. Additional improvements can be realized by welding the hinges. While with all of these measures the strenght of the door, the lock and the hinges, is increased, still the basic problem remains that the pressure, when applying an external force to the door, essentially is concentrated at three points.

SUMMARY OF THE INVENTION

Hence, with the foregoing in mind, it is a primary object of the present invention to provide a new and improved construction of door arrangement which overcomes the aforementioned drawbacks and limitations of the prior art proposals.

Another and more specific object of the present invention aims at avoiding these disadvantages and providing a burglary proof door arrangement, especially for closing a residence, wherein the locking bolt of the lock and the hinges are relieved of the forces acting upon the door when attempts are made to force the door from the outside.

Still a further significant object of the present invention relates to a new and improved construction of door arrangement which is relatively simple in design, economical to manufacture, and provides extreme security against unauthorized entry.

Now in order to implement these and still further objects of the invention, which will become more readily apparent as the description proceeds, the door arrangement of the present development is constructed such that the door both at the hinge side as well as at the lock side is engaged throughout its entire height, when the door is in its closed position, by U-shaped guides provided at the door frame, and the part of the door at the side of the lock which is engaged or spanned in a U-shaped manner by the door frame is arranged to be movable transversely with respect to the direction of opening of the door.

According to a preferred embodiment the movable door part comprises two rails extending over the entire door height. These rails are pivotably mounted in a slot-shaped groove located at the narrow side of the door at the side of the lock. The point of rotation of the one rail is arranged at the lower edge and the point of rotation of the other rail at the upper edge of the door. Both of the rails possess a respective mutually overlapping opening at one half of the height of the door, and into which there can engage an entrainment bolt connected with the locking bolt of the door lock.

A further construction of the door arrangement of the invention contemplates configuring each opening located in the rails essentially in the form of an elongate hole which opens at its one lengthwise side and in which the entrainment bolt is arranged in such a fashion that the rails can be entrained, only after displacing the locking bolt from its first closed or locking position into a second closed position, whereafter they assume a position shifted out of the slot-shaped groove and are engageable approximately free of play into the substantially U-shaped guide of the door frame part at the side of the lock.

In order to still be able to open from the inside the movable door part of the door which may become jammed when force is applied from the outside, a further advantageous construction of the invention contemplates threadably connecting in a first recess or niche arranged at the inside of the door a housing which can be dismantled from the inside and composed of chamferred or bevelled sections and extending over the entire height of the door. The door lock is attached to such housing and its rear wall together with a second recess or niche extending over the entire height of the door forms the slot-shaped groove.

It is furthermore of advantage of construct the door edge at the side of the hinges such that in the closed position of the door there is not present any intermediate space between the door and the U-shaped guide of the hinge side-door frame part. For this purpose, the outer edge of the door is provided over its entire height with a bevelled or chamferred portion, and the U-shaped guide is accommodated to such shape.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
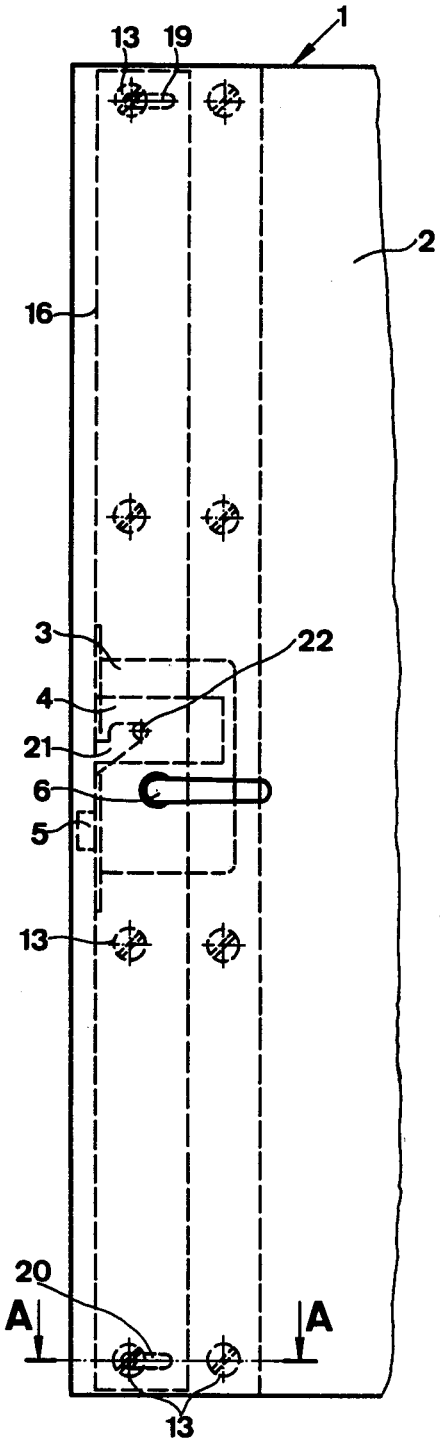
FIG. 1 is a fragmentary view of a door of the inventive door arrangement, shown in a non-closed position, with retracted movable door part.
Figure 2:
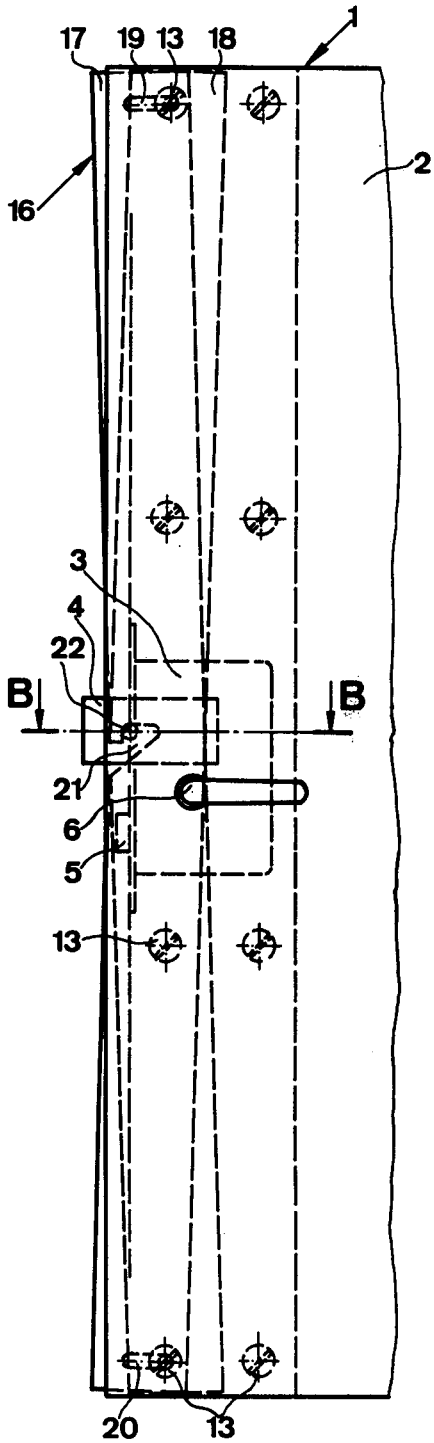
FIG. 2 is a fragmentary view of the door, this time in its closed position, which extended movable door part.

Describing now the drawings, in FIGS. 1–4, reference character 1 designates a single-wing door of a residence, such as used for closing the entrance of an apartment or house. The door 1 comprises hollow sections or profile members, as will be explained more fully hereinafter, composed of metallic chamferred or bevelled sections lined or faced with the coverings 2. A door lock 3, embodying a locking bolt 4 or equivalent structure, a latch or catch 5 and an actuation handle or grip 6, is secured in a housing 11 formed of the metallic bevelled or chamferred sections 7, 8, 9, 10. This housing 11 extends over the entire height of the door and is inserted into a recess or niche 12 of the door 1 and threaded therewith by means of screws or threaded bolts 13 or other suitable or equivalent fastening devices. The rear wall 8 of the housing 11 together with a further recess or niche 14 extending over the entire door height, forms a slot-shaped groove 15 which is open at the narrow side of the door 1 at the side of the lock 3.

In this substantially slot-shaped groove 15 there is arranged a movable door part 16 composed of two rails 17 and 18 extending over the entire door height. These rails or rail members 17 and 18 are alternately rotatably mounted by means of one of the screws 13 arranged at the lower and the upper edge, respectively, of the door 1. The free ends of the rails 17 and 18 possess slots 19 and 20, respectively, by means of which they are alternately guided at the same screws 13. The rails 17 and 18 are provided at approximately half the height of the door with a respective overlapping or aligned opening 21 into which there can engage an entrainment bolt 22 connected with the locking bolt 4 of the door lock 3. Each opening 21 is essentially in the form of an elongate hole open at one of its lengthwise sides, so that during mounting of the door lock 3 the entrainment bolt 22 can be easily inserted. The entrainment bolt 22 is arranged in the elongate hole 21 in such a manner that the rails 17 and 18, only after displacing the locking bolt 4, can be entrained into a second closed position.

Reference character 24 designates the door frame part at the side of the lock of a door frame 23. This door frame 23, as best seen by referring to FIGS. 3 and 4, will be seen to comprise hollow sections or profiles fabricated from metal chamferred sections or profile members. The door frame part 24, essentially having a substantially U-shaped cross-section, form lockingly or positively engages with the edge of the door opening and is anchored at the brickwork 28 by means of flaps or tongues 25 and screws 26, 27 or equivalent or other suitable fastening devices. Arranged in the door frame part 24 is a substantially U-shaped guide 29 which extends over the entire height of the door, and in which guide 29 there engages approximately free of play the movable door part 16 composed of the rails 17 and 18 upon displacement of the locking bolt 4 into its second closed position.

Figure 3:
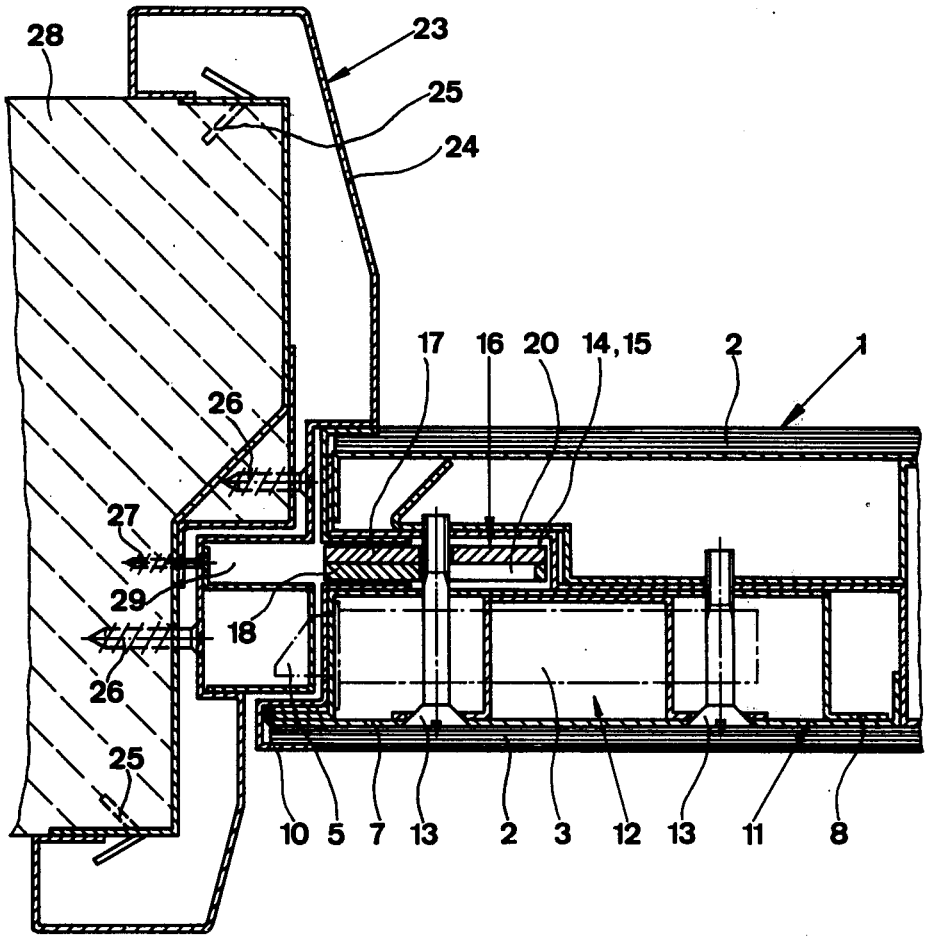
FIG. 3 is a cross-sectional view, taken substantially along the line A—A of FIG. 1, showing the door frame part at the side of the lock and on an enlarged scale in relation to the illustration of FIG. 1.
Figure 4:
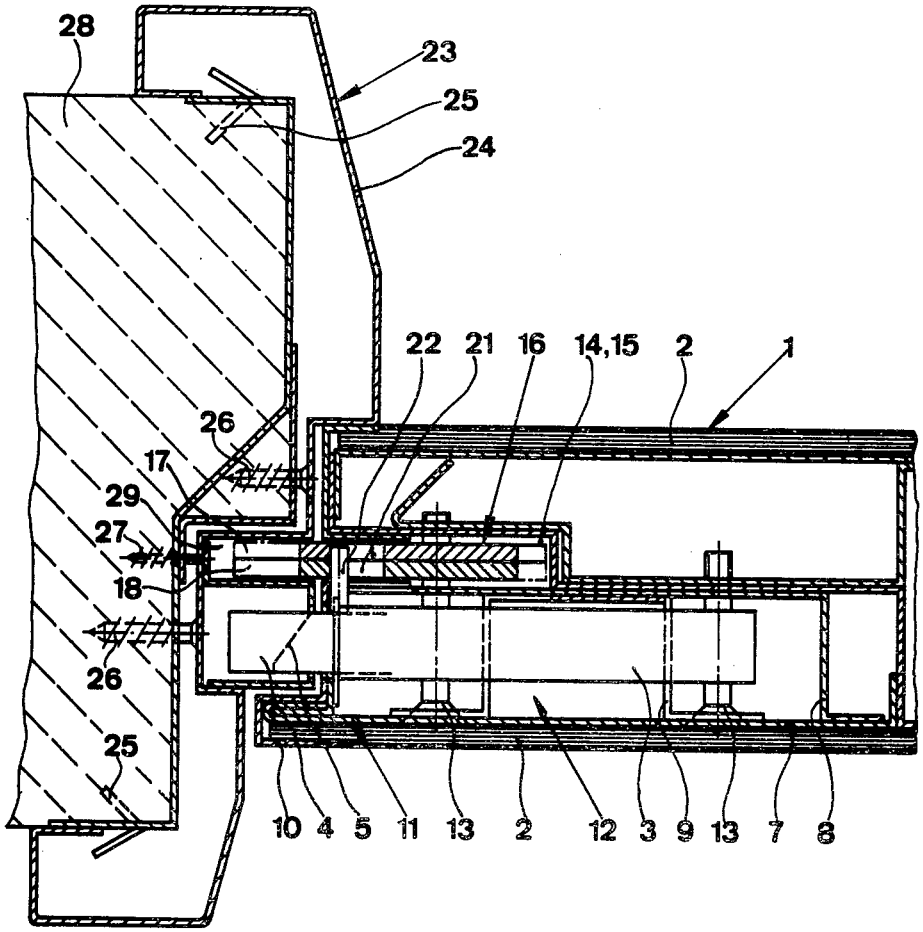
FIG. 4 is a cross-sectional view, taken substantially along the line B—B of FIG. 2, showing the door frame part at the side of the lock, and on an enlarged scale in relation to the illustration of FIG. 2.
Figure 5:
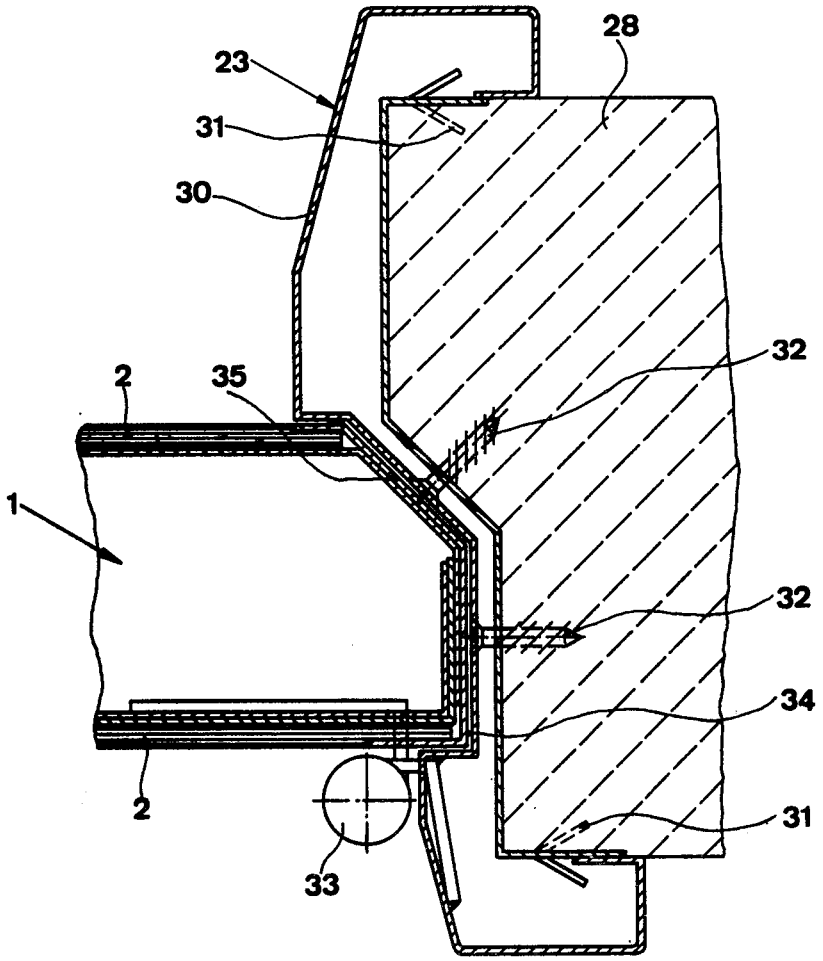
FIG. 5 is a partial cross-sectional view of the door arrangement at the side of the hinges, and on an enlarged scale in relation to FIGS. 3 and 4.

Now in FIG. 5 reference characters 1, 2, 23 and 28 designate the same parts as in the showing of FIGS. 1–4. The hinge side-door frame part 30 of the door frame 23 likewise possesses a substantially U-shaped cross-section which positively or form lockingly engages the edge of the door opening and is anchored by means of flaps or tongues 31 and screws 32 or the like in the brickwork 28. An inner situated hinge 33 is welded with the door 1 and with the door frame part 30. Arranged in the door frame part 30 is an essentially U-shaped guide 34 which extends over the entire door height, and in which guide 34 there engages the door 1 in its closed position. In order to prevent that in this position there is formed an intermediate space between the door 1 and the U-shaped guide 34, the outer situated edge of the door 1 is provided over its entire height with a champfer or bevel 35, and the U-shaped guide 34 is accommodated to such shape.

The edges of the door opening which are encompassed by the door frame parts 24, 30 are constructed in a stepwise manner such that the inner horizontal width of the door opening is greater than the outer horizontal width, and the door frame parts 24, 30 are accommodated to such stepwise shape of the edges, as best seen by referring to FIGS. 3, 4 and 5.

The advantages realized when practising the invention particularly reside in that, on the one hand, the locking bolt 4 of the door lock 3 and, on the other hand, the hinges 33 are relieved of load when forces act upon the door 1 from the outside, since such components are received in the U-shaped guides 29, 34 of the door frame 23, so that the door 1 can only be broken open with difficulty when using techniques normally employed during unlawful entry or burglaries. The intermediate space between the door 1 and the U-shaped guide 34 which is avoided by carrying out the special construction of the hinge side-outer edge of the door 1, and equally the steplike construction of the edge of the door opening, exceedingly renders more difficult any effective use of a burglary tool. A further advantage resides in that upon jamming or binding of the movable door part 16 the door 1 nonetheless can be opened from the inside in that the housing 11 containing the door lock 3 and inserted into the recess 12, can be threadably disconnected, after removing the covering 2.

While there are shown and described present preferred embodiments of the invention, it is to be distinctly understood that the invention is not limited thereto, but may be otherwise variously embodied and practiced within the scope of the following claims accordingly.

What I claim is:

1. A door arrangement, especially for closing the entrance to a residence having a door opening, comprising:

a door frame mounted in the door opening;

said door frame comprising metal hollow sections;

a single-wing door composed of metal hollow sections;

said door being lined with coverings;

hinge means for hingedly connecting the door with the door frame at the inside of the door arrangement;

a door lock having a locking bolt and latch provided at the inside of the door arrangement;

substantially U-shaped guides provided at the door frame;

said substantially U-shaped guides engaging about the door both at the side of the hinge means and at the side of the door lock over the entire height of the door when the door assumes a closed position;

said door having a movable door part which is engaged in a U-shaped manner by the door frame at the side of the door lock;

said movable door part having its pivot axis substantially perpendicular to the pivot axis of the door; and means for mounting said movable door part to be pivotably movable transversely with respect to the direction of opening of the door.

2. The door arrangement, especially for closing the entrance to a residence having a door opening, comprising:

a door frame mounted in the door opening;

said door frame comprising metal hollow sections;

a single-wing door composed of metal hollow sections;

said door being lined with converings;

hinge means for hingedly connecting the door with the door frame at the inside of the door arrangement;

a door lock having a locking bolt and latch provided at the inside of the door arrangement;

substantially U-shaped guides provided at the door frame;

said substantially U-shaped guides engaging about the door both at the side of the hinge means and at the side of the door lock over the entire height of the door when the door assumes a closed position;

said door having a movable door part which is engaged in a U-shaped manner by the door frame at the side of the door lock;

means for mounting said movable door part to be movable transversely with respect to the direction of opening of the door;

said movable door part comprises two rails extending over the entire height of the door;

said door having a narrow side located at the side of the door lock provided with a substantially slot-shaped groove;

said mounting means including means for pivotably mounting said two rails in said substantially slot-shaped groove;

said pivotably mounting means defining a point of rotation for one of the rails at a lower edge of the door and a point of rotation of the other rail at an upper edge of the door;

both of said rails being provided with a respective overlapping opening at appoximately one half of the door height;

an entrainment bolt connected with the locking bolt of the door lock; and said entrainment bolt being engageable with said openings.

3. The door arrangement as defined in claim 2, wherein:

each of the openings of the rails essentially comprises an elongate hole open at one of its lengthwise sides;

said entrainment bolt being arranged in said elongate hole of each opening such that the rails first can be entrained upon shifting of the locking bolt into a second closed position, whereafter said rails assume a position shifted out of the slot-shaped groove and can be engaged approximately free of play with one of said U-shaped guides provided at the door frame at the part of the door frame located at the side of the door lock.

4. The door arrangement as defined in claim 3, further including:

means defining a first recess at the inside of the door;

a housing composed of bevelled sections and extending over the entire height of the door arranged in said first recess;

means for detachably connecting the housing from the inside to the inner side of the door in said recess;

said door lock being secured in said housing;

said door being provided with a second recess extending over the entire height of the door;

said housing having a rear wall;

said rear wall together with said second recess forming said substantially slot-shaped groove.

5. The door arrangement, especially for closing the entrance to a residence having a door opening, comprising:

a door frame mounted in the door opening;

said door frame comprising metal hollow sections;

a single-wing door composed of metal hollow sections;

said door being lined with coverings;

hinge means for hingedly connecting the door with the door frame at the inside of the door arrangement;

a door lock having a locking bolt and latch provided at the inside of the door arrangement;

substantially U-shaped guides provided at the door frame;

said substantially U-shaped guides engaging about the door both at the side of the hinge means and at the side of the door lock over the entire height of the door when the door assumes a closed position;

said door having a movable door part which is engaged in a U-shaped manner by the door frame at the side of the door lock;

said door has an outer edge at the side of the hinge means possessing a bevelled portion extending over the entire height of said door;

said U-shaped guides comprising a U-shaped guide provided at the part of the door frame at the side of the hinge means;

said U-shaped guide at the part of the door frame at the side of the hinge means being matched to the shape of said bevelled portions; and said U-shaped guide at the part of the door frame at the side of the hinge means engaging about the door in the closed position thereof.

6. The door arrangement, especially for closing the entrance to a residence having a door opening, comprising:

a door frame mounted in the door opening;

said door frame comprising metal hollow sections;

a single-wing door composed of metal hollow sections;

said door being lined with coverings;

hinge means for hingedly connecting the door with the door frame at the inside of the door arrangement;

a door lock having a locking bolt and latch provided at the inside of the door arrangement;

substantially U-shaped guides provided at the door frame;

said substantially U-shaped guides engaging about the door both at the side of the hinge means and at the side of the door lock over the entire height of the door when the door assumes a closed position;

said door having a movable door part which is engaged in a U-shaped manner by the door frame at the side of the door lock;

means for mounting said movable door part to be movable transversely with respect to the direction of opening of the door;

said door frame possesses an essentially U-shaped cross-sectional configuration;

the door opening being formed in brickwork of the residence; and said door opening having an edge which can be engaged in a U-shaped manner by the U-shaped cross-sectional door frame.

7. The door arrangement as defined in claim 6, wherein:

the door opening includes vertically extending edges engaged in a substantially U-shaped manner by the door frame;

said vertically extending edges of the door opening being constructed in a stepwise manner such that the inner horizontal width of the door opening is greater than the outer horizontal width of the door opening; and said door frame being accommodated to the stepwise shape of the edges of the door opening.

8. A door arrangement, especially for closing the entrance to a residence having a door opening, comprising:

a door frame for the door opening;

a door cooperating with the door frame;

hinge means for hingedly connecting the door with the door frame at the inside of the door arrangement;

a door lock provided at the inside of the door arrangement;

substantially U-shaped guides provided at the door frame;

said substantially U-shaped guides engaging about the door both at the side of the hinge means and at the side of the door lock over the entire height of the door when the door assumes a closed position;

said door having a movble door part which is engaged in a substantially U-shaped manner by the door frame at the side of the door lock;

said movable door part having its pivot axis substantially perpendicular to the pivot axis of the door; and means for mounting said movable door part to be pivotably movable substantially transversely with respect to the direction of opening of the door.

* * * * *